United States Patent [19]

Minakuchi

[11] Patent Number: 4,827,824

[45] Date of Patent: May 9, 1989

[54] ELECTRIC GUITAR HAVING AN ELECTRONIC VIBRATO APPARATUS

[75] Inventor: Kiyoshi Minakuchi, Hamamatsu, Japan

[73] Assignee: Yamaha Corporation, Hamamatsu, Japan

[21] Appl. No.: 207,319

[22] Filed: Jun. 14, 1988

[30] Foreign Application Priority Data

Jun. 15, 1987 [JP] Japan ..... 62-149440

[51] Int. Cl.[4] ..... G10H 1/053; G10H 3/18

[52] U.S. Cl. ..... 84/1.16; 84/1.25

[58] Field of Search ..... 84/1.16, 1.24, 1.25, 84/DIG. 4, DIG. 26

[56] References Cited

FOREIGN PATENT DOCUMENTS 61-44240 12/1986 Japan .

62-38699 3/1987 Japan .

OTHER PUBLICATIONS

*Nikkei Electronics*, 1984.9.24, pp. 134–137.

*Primary Examiner*—Stanley J. Witkowski

*Attorney, Agent, or Firm*—Blakely, Sokoloff, Taylor & Zafman

[57] ABSTRACT

An electric guitar having a vibrato function includes first and second operation elements and an operating unit. The first operation element can designate a pitch width to be changed by setting a first pitch width as a unit. The second operation element can designate a pitch width to be changed by setting a pitch width smaller than the first pitch width as a unit. The operating unit performs an operation of the pitch width to be changed, which has been designated by the first operation element, and of the pitch width to be changed, which has been designated by the second operation element. The operating unit forms the control information representing a width of pitch change of a vibrato to be imparted on the basis of the operation result, thereby imparting the vibrato effect on a musical tone to be produced in accordance with the control information.

2 Claims, 7 Drawing Sheets

ELECTRIC GUITAR HAVING AN ELECTRONIC VIBRATO APPARATUS

BACKGROUND OF THE INVENTION

The present invention relates to an electric guitar and, more particularly, to an electronic vibrato apparatus capable of accurately designating pitch widths for a vibrato effect in a multistep manner using a plurality of operation elements for designating different units of pitch width.

An electric guitar disclosed in Japanese Utility Model Laid-Open No. 62-38699 is known as a conventional electric guitar of this type. A schematic description of this electric guitar will be made below. The electric guitar disclosed in Japanese Utility Model Laid-Open No. 62-38699 serves to generates a vibrato effect by electronic signal processing. According to this electric guitar, an analog signal output from an electromagnetic pick-up is sampled with a first sampling frequency, and then a digital signal corresponding to each of the sampled analog signal is temporarily stored in a memory. The digital signal stored in the memory is read out and converted into an analog signal again. This analog signal is sampled with a second sampling frequency to form an output signal. This second sampling frequency is selected on the basis of a control signal which is supplied from a rotary switch and can be changed stepwise. The rotary switch can designate a pitch width for vibrato at an interval of a semitone. Therefore, in this electric guitar, the second sampling frequency can be increased/decreased stepwise by operating the rotary switch, and the pitch of a musical tone generated in accordance with a ratio of the first sampling frequency to the second sampling frequency can be changed.

Generally, when a vibrato is provided to a musical tone, it is perceived as if the musical tone were vibrated with its pitch (fundamental pitch) kept constant. However, if the width of change in pitch is excessively large, changes in fundamental pitch can be clearly perceived. As a result, the vibrato effect to be originally desired cannot be obtained.

According to a vibrato apparatus in the above-described conventional electric guitar, since the width of a vibrato is designated in unit of pitch width corresponding to a semitone via the rotary switch, it is necessarily difficult for a performer to designate an arbitrary width of a vibrato by the rotary switch. In the worse case, the pitch width designated by the rotary switch becomes larger than a desired pitch width, and it is perceived that the fundamental pitch of a musical tone is changed in the above-described manner, thereby failing to obtain the vibrato effect to be originally desired.

SUMMARY OF THE INVENTION

It is, therefore, a principal object of the present invention to provide an electric guitar capable of accurately providing a vibrato to a generated musical tone.

In order to achieve the above object, there is provided an electric guitar including an analog signal generator for converting mechanical vibrations of a string into a first analog signal corresponding thereto and outputting the first analog signal, an A/D converter for converting the first analog signal into a digital signal corresponding thereto and outputting the digital signal, signal adjusting means for omitting or repeating a part of information included in the digital signal on the basis of first control information and forming an adjusted digital signal, a D/A converter for converting the converting the adjusted digital signal into a second analog signal and outputting the second analog signal, pitch changing means for changing a pitch of the second analog signal on the basis of second control information and outputting an adjusted analog signal whose pitch has been changed, and musical tone generating means for generating a musical tone on the basis of the adjusted analog signal, comprising, a first operation element for generating the first information designating a pitch width to be changed by setting a first pitch width as a unit, a second operation element for generating the second information designating an amount of pitch to be changed by setting a pitch width smaller than the first pitch width as a unit, and operating means for performing an operation of the first control information and the amount of pitch and for forming the second control information representing a pitch of the second analog signal to be changed on the basis o the operation result.

When a performer desires to provide a vibrato to a musical tone to be generated during a performance of the electric guitar with the above arrangement, the vibrato width to be provided is designated by operating first and second operation elements 13 and 15 upon picking a string. When a string of the electric guitar is picked, mechanical vibrations are generated by the string, and the mechanical vibrations are converted into an analog signal by an analog signal generator 1. This analog signal corresponds to the mechanical vibrations generated by string, and hence its waveform reflects the frequency of mechanical vibrations generated by the string. The analog signal is converted into a digital signal by a first 3. Since this digital signal corresponds to the analog signal, it indirectly reflects the frequency the mechanical vibrations.

DESCRIPTION OF THE PREFERRED EMBODIMENT

An embodiment of the present invention will be described with reference to the accompanying drawings.

Figure 1:
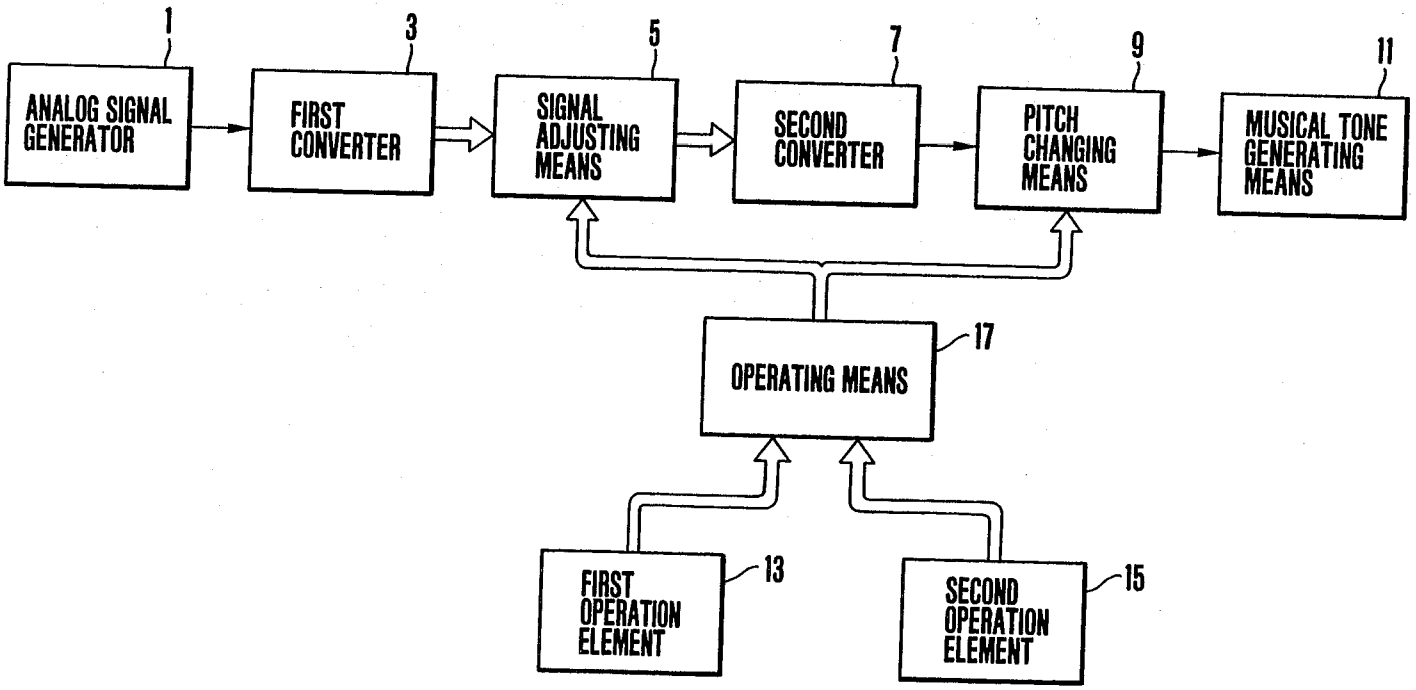
FIG. 1 is a view corresponding to the claims of the present invention, for showing a structure thereof.
Figure 2:
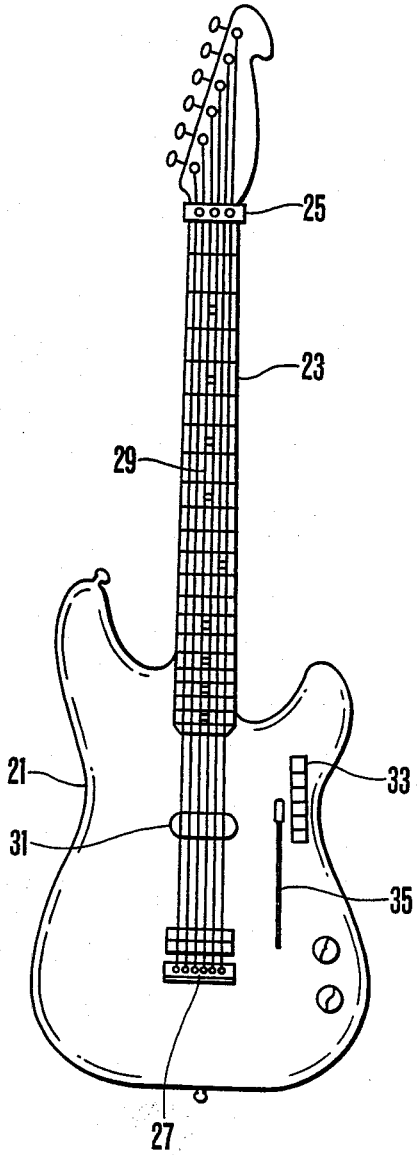
FIG. 2 is a front view showing an electric guitar including the present invention.

FIGS. 1 to 7 show the embodiment of the present invention. The overall arrangement of the present invention will be described below with reference to FIG. 2. Referring to FIG. 2, reference numeral 21 denotes a body of an electric guitar. A lock nut 25 for locking strings is arranged at the distal end of a neck 23 extending from the body 21. Six strings 29 having diameters different from each other are tightened between the lock nut 25 and a tail piece 27. An electromagnetic pick-up 31 serving as an analog signal generator 1 is fixed on the body 21 under the strings 29. In addition, switches 33 serving as the first operation element 13 and an operation lever 35 serving as the second switches 15 are arranged on the body 21. The electromagnetic pick-up 31, the switches 33, and the operation lever 35 are electrically connected to a control circuit to be described in detail later.

Figure 3:
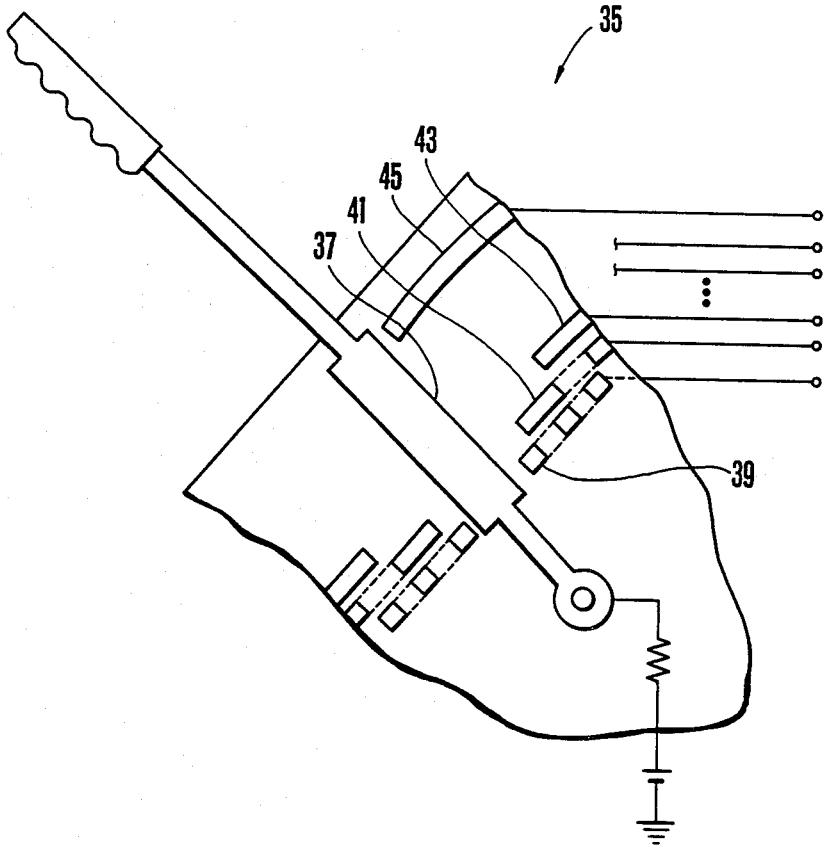
FIG. 3 is a front view showing a structure of an operation lever according to the embodiment.

A plurality of push buttons constituting the switches 33 serve to designate the width of change in pitch for a vibrato by setting a first pitch width, e.g., a pitch width corresponding to a whole tone, as a unit. When an performer depresses any one of the push buttons, a digital signal representing the pitch width corresponding to the depressed push button is output to the control circuit. The operation lever 35 can be pivoted in any one of the two directions from a neutral position. When the operation lever is pivoted in one direction, it outputs a digital signal representing that pitch of a musical tone is to be decreased by the width of change in pitch corresponding to the pivotal angle. When the operation lever is pivoted in the other direction, it outputs a digital signal representing that the pitch of a musical tone is to be increased by the width of change in pitch corresponding to the pivotal angle. The unit pivotal angle of the operation lever 35 represents a pitch width (to be referred to as a second pitch hereinafter) of $\frac{1}{2}^n$ (n is an integer) of the pitch width designated by any one of the switches 33. FIG. 3 shows a detailed arrangement of the operation lever 35. Accordingly, the operation lever 35 comprises a sliding contact 37 to which a positive voltage is applied, and (n+1) rows of stationary contacts 39, 41, 43, . . . , 45 with which the sliding contact 37 can be brought into slidable contact. The stationary contacts 39, 42, 43, . . . , 45 are discontinuously exposed. When the sliding contact 37 is pivoted, it is selectively brought into slidable contact with the stationary contacts 39, 41, 43, . . . , 45, thereby generating a (n+1)-bit digital signal. The n bits 39 (LSB), 41, 43, . . . of a digital signal output from the operation lever 35 in this manner represent the value of a pitch width to be changed upon designation of the performer, and the MSB 45 represents that the pitch should be increased or decreased.

Figure 4:
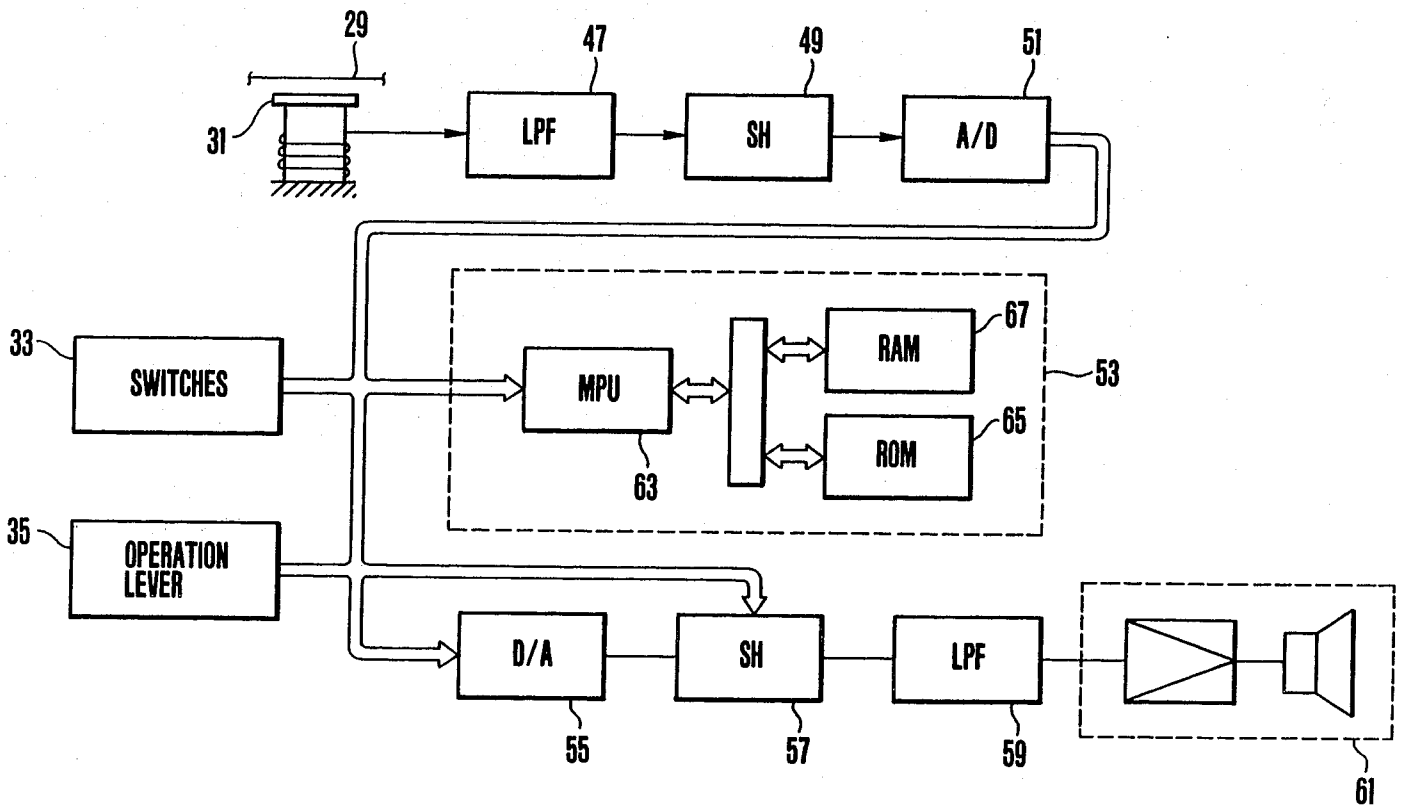
FIG. 4 is a block diagram of a circuit arrangement according to the embodiment of the present invention.

The control circuit according to the embodiment will be described with reference to FIG. 4. Referring to FIG. 4, reference numeral 47 denotes a low-pass filter (LPF) for removing undesired high-frequency components from an analog signal having a waveform corresponding to mechanical vibrations generated by the string 29 and supplied from the electromagnetic pick-up 31, and supplying the resultant signal to a sample/hold circuit (SH) 49 of a next stage. The sample/hold circuit 49 receives the analog signal from which the high-frequency components have been removed, and then samples the analog signal using a first sampling frequency f0, thereby supplying the sampled data to an A/D converter (A/D) 51 serving as the first converter 3. The sampled data converted into an analog signal by the A/D converter 51 is fetched by information processor 53 together with the data regarding the pitch width to be changed, which is supplied from the switches 33 and the operation lever 35, and then is subjected to predetermined processing according to the steps shown in FIGS. 5A and 5B to be formed into a converting digital signal. The contents of this processing will be described in detail later.

The converting digital signal formed by the information processor 53 is supplied to a D/A converter (D/A) 55 serving as the second converter 7 and is converted into an analog signal again. Since the information processor 53 supplies data regarding a sampling frequency fl to a sample/hold circuit (SH) 57 serving as the pitch converting means 9 prior to supply of the converting digital signal, the analog signal supplied from the D/A converter 55 is sampled by the sample/hold circuit 57 using the second sampling frequency fl, thereby changing the pitch in accordance with a ratio of the first sampling frequency to the second sampling frequency. The analog signal passing through a low-pass filter (LPF) 59 after the pitch is changed in this manner is supplied to a sound system 61 serving as the musical tone generating means 11. As a result, a musical tone provided with a vibrato is generated by the sound system 61 on the basis of the analog signal. The data regarding the second sampling frequency fl is formed by the information processor 53 on the basis of the data regarding the pitch widths to be changed, which are respectively supplied from the switches 33 and the operation lever 35.

The sample/hold circuit 57 includes a circuit capable of changing sampling clocks on the basis of data from the information processor 53, e.g., a variable frequency divider. The information processor 53 comprises a microprocessing unit (MPU) 63, a read-only memory (ROM) 65 for supplying program instructions and fixed data to the MPU 63, and a random access memory (RAM) 67 for temporarily storing data supplied from the MPU 63. The address and control signal lines of the MPU 63 are omitted.

Figure 5A:
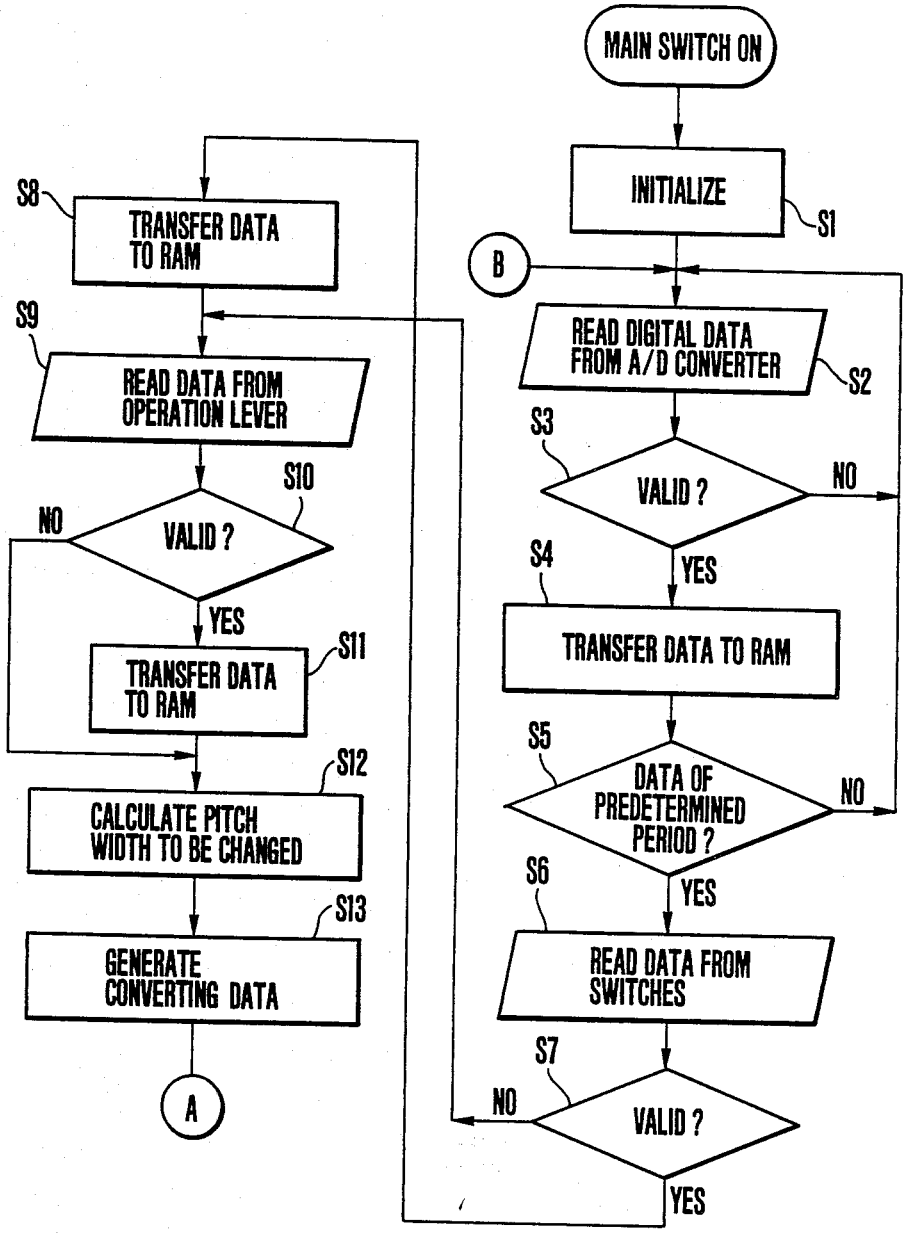
FIGS. 5A is and 5B are flow charts for explaining an operation of the embodiment.
Figure 5B:
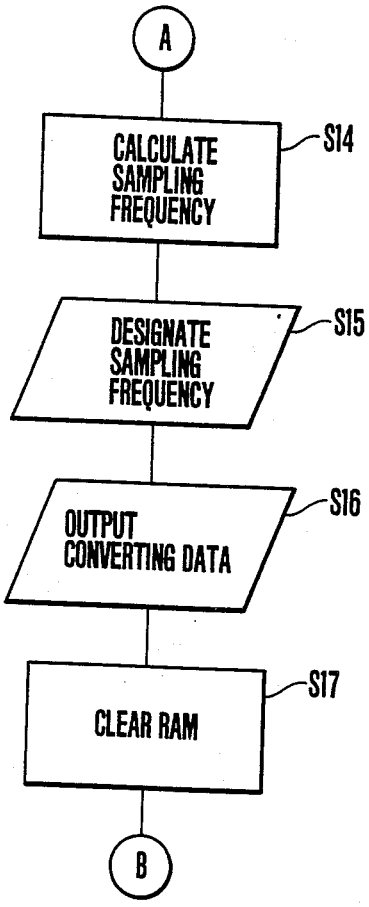

An operation of the embodiment will be described with reference to FIGS. 5A and 5B. When a main switch (not shown) is turned on, the information processor 53 executes an initialization routine (step Sl). In this initialization routine, in addition to initialization of internal registers and the like in the MPU 63, the RAM 67 is cleared, and initial values are respectively read from the switches 33, the operation lever 35, and the A/D converter 51.

When the initialization routine Sl is finished, the MPU 63 scans the A/D converter 51 and stores a digital signal output therefrom in the internal registers (step S2). The MPU 63 compares the data stored in the internal registers with the initial value of the A/D converter in the initialization routine, and determines whether the data is originated from mechanical vibrations generated by the string 29 upon picking (step S3). If the data supplied from the A/D converter 51 is noise (i.e., invalid data), the flow returns to step S2, and steps S2 and S3 are repeatedly executed until YES (Y) is obtained in the determination result in step S3.

When the performer begins a performance of the electric guitar and starts picking, mechanical vibrations are generated by picking in the string 29. The mechanical vibrations are converted into an analog signal by the electromagnetic pick-up 31. Undesired high-frequency components are removed from the analog signal by the low-pass filter 47, and the resultant signal is sampled by the sample/hold circuit 49 using the first sampling frequency f0. Thus, a series of sampled data are sequentially supplied to the A/D converter 51. The data converted into digital data by the A/D converter 51 are sequentially read in the MPU 63 as digital signals (step S2). It is determined whether the data represent mechanical vibrations originated from picking (step S3), and then the data are sequentially stored in the RAM 67 (step S4). The MPU 63 determines whether data of a predetermined period for an analog signal is obtained (step S5) while transferring the data from the A/D converter 51 to the RAM 67. While NO (N) is obtained in step S5, the flow returns to step S2 and data are further read from the A/D converter 51.

When the data of a predetermined period for an analog signal is stored in the RAM 67, YES (Y) is obtained in the determination result in step S5. Therefore, the MPU 63 reads data regarding a pitch width to be changed from the switches 33 (step S6). The MPU 63 compares the data fetched from the switches 33 with the initial value read in the initialization routine (step S7). If the data is valid, i.e., if the switches 33 are operated, YES is obtained in the determination result in step S7. As a result, the data is stored in the RAM 67 (step S8). If NO is obtained in the determination result in step S7 or the data from the switches 33 is stored in the RAM 67, the MPU 63 continues to read data regarding a pitch width to be changed from the operation lever 35 (step S9), and determines whether the data is valid or invalid by comparing it with the initial value of the operation lever (step S10). If the data read from the operation lever 35 is valid, YES is obtained in the determination result in step S10. As a result, the data is transferred to and stored in the RAM 67 (step Sll). If the data read from the operation lever 35 is invalid or valid data is stored in the RAM 67, the MPU 63 reads out the two data regarding pitch widths to be changed from the RAM 67 and executes a predetermined operation of these data, thereby obtaining the pitch width to be changed (step S12).

In this case, if the performer does not desire to generate a vibrato, the pitch width to be changed, which is obtained from the operation result in step S12, becomes "0" because the initial value, typically "0" is stored in the RAM 67. Thus, converting data formed on the basis of the operation result also becomes "0" (step S13). If the performer desires to generate a tone with a vibrato during a performance and operates the switches 33 and the operation lever 35, since the data regarding a pitch width to be changed is stored in the RAM 67, the MPU 63 calculates the pitch width to be changed in the following steps. As described above, the switches 33 can designate a pitch width to be changed using the first pitch width as a unit. For example, if the first switch is depressed, a pitch width corresponding to the whole tone is designated. On the other hand, the operation lever 35 designates a pitch width to be changed by setting $\frac{1}{2}^n$ of the pitch width designated by any one of the switches 33 as a unit. For example, if the operation lever 35 is pivoted in the pitch increasing direction by five unit angles, a change corresponding to $5/2^n$ the pitch is designated. Accordingly, the MPU 63 executes an operation of $$5/2^n \times \text{(Pitch Width Corresponding to Whole Tone)}$$

in step S12, and obtains the pitch width to be changed.

Figure 6:
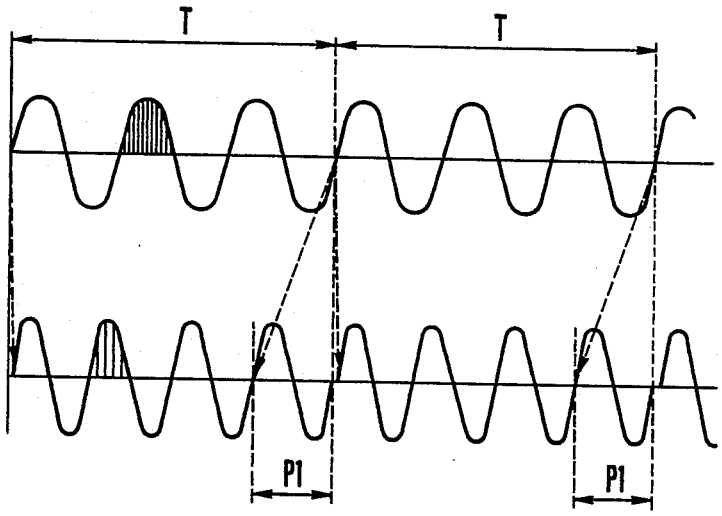
FIG. 6 is a timing chart showing input and output signals according to the embodiment.
Figure 7:
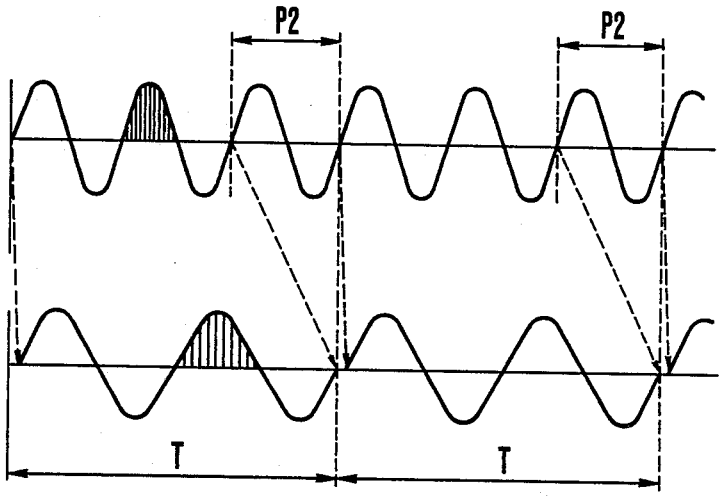
FIG. 7 is a timing chart showing input and output signals according to the embodiment.

When the pitch width to be changed is calculated in this manner, the MPU 63 forms converting data including control information and stores it in the RAM 67 (step S13). This converting data is formed by omitting or overlapping the series of data read from the A/D converter 51. More specifically, when pitches are to be increased, part Pl of the series of data is overlapped in advance, as shown in FIG. 6, so that inconvenience is not caused in picked tone duration time T and the like even if the number of pitches is increased later. In contrast to this, when pitches are to be decreased, as shown in FIG. 7, part of a series of data P2 is omitted so as to prevent the picked tone duration time T and the like from changing.

When the converting data is formed in this manner, the MPU 63 calculates the second sampling frequency fl in accordance with the pitch width calculated in step S12 (step S14). The MPU 63 then supplies data representing the sampling frequency fl to the sample/hold circuit 57 (step 15). That is, when pitches are to be increased, the sampling frequency fl is made lower than the sampling frequency f0, whereas when pitches are to be decreased, the sampling frequency fl is made higher than the sampling frequency f0. Since the sample/hold circuit 57 includes the variable frequency divider as described above, sampling is performed using the second sampling frequency fl on the basis of the data supplied from the MPU 63. After the data is supplied to the sample/hold circuit 57 in this manner, the MPU 63 sequentially reads out the converting data from the RAM 67, forms a digital signal, and supplies it to the D/A converter 55 (step S16). The D/A converter 55 forms an analog signal on the basis of the converting data, and supplies it to the sample/hold circuit 57. The sample/hold circuit 57 samples the analog signal using the second sampling frequency fl and changes its pitch. The pitch of the analog signal supplied to the sound system 61 through the low-pass filter 59 after this operation has been already changed in accordance with the data regarding a change in pitch designated by the switches 33 and the operation lever 35, and hence a musical tone provided with a vibrato is generated from the sound system 61. The MPU 63, which has output the converting data in step S16, clears the RAM 67 (step S17). Then, the flow returns to step S2, and steps S2 to S17 are repeated. In the embodiment, therefore, the MPU 63, the RAM 67, steps S6 to S12, and steps S14 and S15 constitute an operating means 17. In addition, the MPU 63, the RAM 67, steps S2 to S5, and step S13 constitute a signal adjusting means 5.

In the above-described embodiment, the first and second operation elements 13 and 15 are respectively constituted by the switches 33 and the operation lever 35. However, a circuit obtained by combining these operation elements with a rotary switch, or combining a variable resistor with the A/D converter may be used.

Furthermore, according to the embodiment, a maximum width of change in pitch is designated by the switches 33, and a pitch width to be actually changed is determined by causing the operation lever 35 to designate a ratio to the maximum width of change in pitch. This means that the operating means executes a multiplication. However, the first and second pitch widths may be added to each other, subtracted from each other, or divided by each other using the operating means. In addition, the operating means may execute a combination of the four arithmetic operations.

Moreover, the first pitch width need not correspond to the whole tone, but may correspond to the semitone or other pitch widths.

According to the present invention, when the performer roughly designates a pitch width to be changed using the first operation element 13 and finely designates a pitch width to be changed using the second operation element 15 in the above-described manner, the operating means 17 performs an operation (one of the four arithmetical operations or a combination thereof) of the pitch width to be changed, which has been designated by the first operation element 13, and of the pitch width to be changed, which has been designated by second operation element 15, thereby forming the control information representing the pitch width of the analog signal to be changed on the basis of the operation result. Therefore, the signal adjusting means 5 omits or overlaps part of the information included in the digital signal to form the converting digital signal in order to prepare for a change in pitch width to be subsequently executed by a pitch changing means 9. This converting digital signal is supplied to a second converter 7 to be converted into an analog signal. Then, the pitch changing means 9 changes the pitch of the analog signal supplied from the second converter 7 on the basis of the control information. The analog signal with its pitch changed is supplied to the musical tone generating means 11. The musical tone generating means 11 generates a musical tone having a pitch different from that of the mechanical vibrations generated upon picking of the string by the pitch width designated by the first and second operation elements 13 and 15 on the basis of the supplied analog signal. As a result, a vibrato can be provided to the musical tone.

As has been described above, in the electric guitar according to the present invention, the width of a vibrato is roughly designated by the first operation element 13, and then can be finely designated by the second operation element 15. Therefore, the width of a vibrato is not erroneously designated, and can be accurately set to a value desired by the performer. As a result, the desired vibrato effect described above can be provided to a musical tone, and hence the performer can obtain a desired effect for a musical expression.

What is claimed is:

1. An electric guitar including an analog signal generator for converting mechanical vibrations of a string into a first analog signal corresponding thereto and outputting said first analog signal, an A/D converter for converting said first analog signal into a digital signal corresponding thereto and outputting the digital signal, signal adjusting means for omitting or repeating a part of information included in the digital signal on the basis of first control information and forming an adjusted digital signal, a D/A converter for converting said adjusted digital signal into a second analog signal and outputting said second analog signal, pitch changing means for changing a pitch of said second analog signal on the basis of second control information and outputting an adjusted analog signal whose pitch has been changed, and musical tone generating means for generating a musical tone on the basis of said adjusted analog signal, comprising:

a first operation element for generating said first information designating a pitch width to be changed by setting a first pitch width as a unit;

a second operation element for generating said second information designating an amount of pitch to be changed by setting a pitch width smaller than said first pitch width as a unit; and operating means for performing an operation of said first control information and said amount of pitch and for forming said second control information representing a pitch width of said second analog signal to be changed on the basis of the operation result.

2. A guitar according to claim 1, wherein said first operation element comprises push buttons serving as designating said first information, and said second operation means is means capable of being pivoted in any one of two directions from a neutral position and outputting a gradually increased digital signal output representing said amount of pitch.

* * * * *

UNITED STATES PATENT AND TRADEMARK OFFICE

CERTIFICATE OF CORRECTION

PATENT NO. : 4,827,824

DATED : 05/09/89

INVENTOR(S) : Minakuchi

It is certified that error appears in the above-identified patent and that said Letters Patent is hereby corrected as shown below:

| COLUMN | LINE | DESCRIPTION |
|---|---|---|
| 02 | 18 | insert --width-- after "pitch" |
| 02 | 19 | delete "o" insert --of-- |
| 02 | 34 | insert --converter-- before "3" |
| 02 | 47 | delete "is" |
| 03 | 25 | delete "n" insert --n-- |
| 03 | 37 | delete "n" insert --n-- |

Signed and Sealed this

Twelfth Day of December, 1989

*Attest:*

JEFFREY M. SAMUELS

*Attesting Officer*

*Acting Commissioner of Patents and Trademarks*